United States Patent [19]

Eppenbach

[11] 4,417,672

[45] Nov. 29, 1983

[54] DISPENSER FOR FLOWABLE MATERIAL

[76] Inventor: Lawrence C. Eppenbach, 419 Kennedy St., Juneau, Ak. 99801

[21] Appl. No.: 327,942

[22] Filed: Dec. 7, 1981

[51] Int. Cl.[3] ..... B67B 7/26

[52] U.S. Cl. ..... 222/81; 222/83.5; 222/90; 222/545

[58] Field of Search ..... 222/81, 89, 90, 80, 222/83, 83.5, 545

[56] References Cited

U.S. PATENT DOCUMENTS

| | | | |
|---|---|---|---|
| 1,889,557 | 11/1932 | Lange | 222/90 |
| 2,561,903 | 7/1951 | Britton | 222/90 |
| 2,933,218 | 4/1960 | Scaglione | 222/90 |
| 3,599,836 | 8/1971 | Hegi | 222/90 |

*Primary Examiner*—Robert B. Reeves
*Assistant Examiner*—Russell D. Stormer
*Attorney, Agent, or Firm*—Gordon L. Peterson

[57] ABSTRACT

A dispenser for penetrating a container and dispensing flowable material from the container comprising an elongated penetrator having a puncturing end portion and an inner end portion remote from the puncturing end portion, a cap and a neck for attaching the penetrator to the cap. The dispenser has ramp surfaces projecting laterally outwardly of the penetrator and generally facing the cap. A passage extends through the dispenser.

14 Claims, 9 Drawing Figures

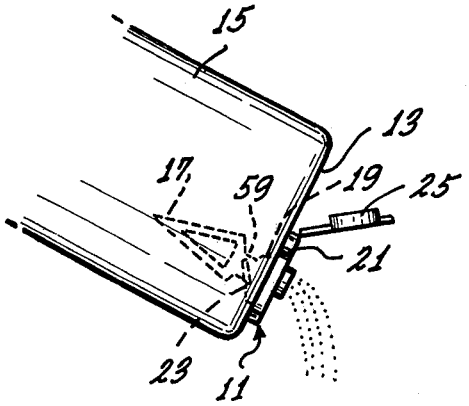
FIG. 1
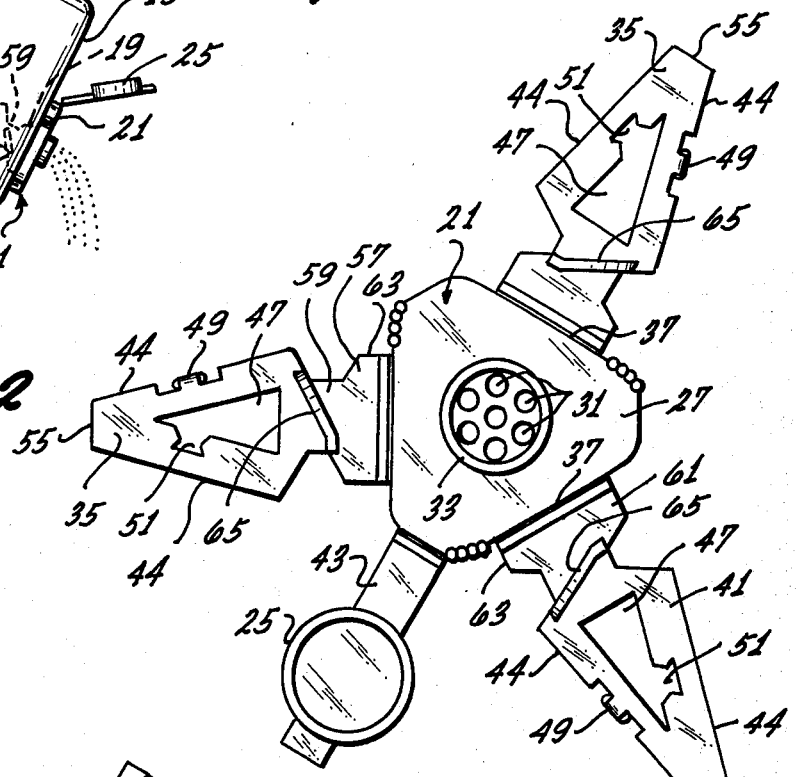
FIG. 2
FIG. 3
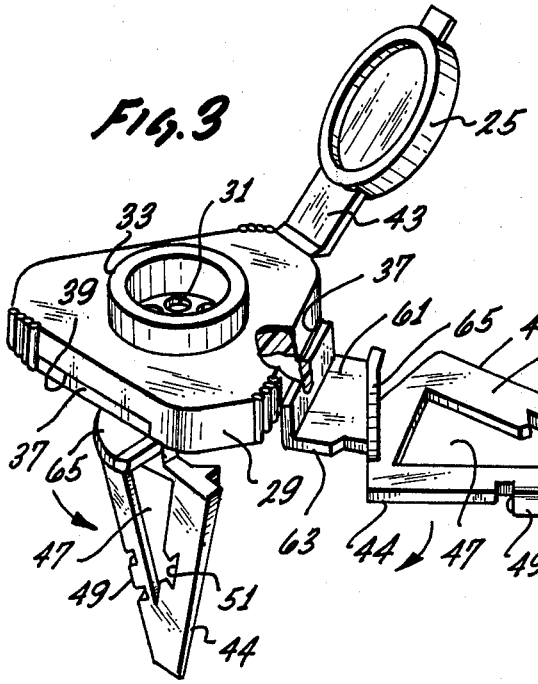
FIG. 4
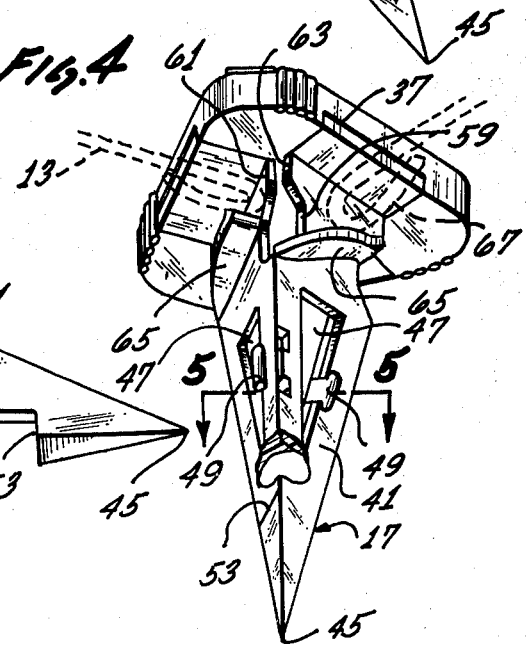

DISPENSER FOR FLOWABLE MATERIAL

BACKGROUND OF THE INVENTION

Containers for various different kinds of flowable material often have no means for dispensing the contents of the container. For example, containers for various granular food products, such as salt and sugar, may have no dispenser. Containers of this type may be in the form of a paper sack or cardboard box.

To dispense the contents of the sack or box, the container must be forcibly opened and the contents poured from the container through what may be a relatively large opening. This makes control of the pouring operation difficult, and it can be very difficult to dispense only a small portion of the contents. In addition, it is difficult to adequately close the opening so as to isolate the granular food product from undesirable environmental factors, such as moisture and contaminants.

One prior art dispenser used for pouring motor oil from a can includes a tubular pointed member which is adapted to axially penetrate the end wall of an oil can and then be twisted. This type of dispenser would not be suitable for a container made of more readily tearable material, such as paper or cardboard, because it would not be adequately retained in sealing relationship against the end wall of the container. This dispenser is not adapted to be used repeatedly over a long period of time with the same container as would typically be the case with a dispenser for granulated food products.

SUMMARY OF THE INVENTION

This invention provides a dispenser which can be used to penetrate a container and to dispense the contents of the container even though the container is constructed of a material, such as paper or cardboard. The dispenser keeps the opening in the container sealed even though the contents are dispensed intermittently over a long period of time. This enables the dispensing operation to be much more closely controlled and permits the dispensing of a relatively small quantity of the contents of the container, when desired. In addition, the dispenser may be provided with a closure so that the container can be substantially closed to protect the contents of the container.

This can be accomplished by providing a dispenser which includes an elongated penetrator having a puncturing end portion configured to facilitate the puncturing of the wall of a container to form an opening in the wall of the container. To close the opening formed in the wall of a container, the dispenser includes a cap which is attached to the penetrator by suitable connecting means which may include a neck. This enables the cap to be on the exterior of the wall of the container when the penetrator is within the container and the neck can project through the opening in the wall of the container to join the penetrator to the cap. To permit dispensing of the contents of the container, the dispenser includes passage means extending through the dispenser and the cap. Preferably, the outlet of the passage can be selectively closed by a closure.

One problem with a dispenser of this type occurs in sealing of the dispenser to the container. When the penetrator is forced through the wall of the container, regions of the wall of the container are folded back to form the opening in the wall of the container. These folded back regions tend to have some stiffness and resilience depending upon the nature of the material from which the container wall is constructed. This invention uses these folded-back regions to tend to hold the cap against the exterior wall of the container to seal the opening.

This can be accomplished by providing means adjacent the inner end portion of the penetrator and projecting laterally outwardly for engaging at least a portion of the folded-back regions of the wall of the container. Such means can advantageously include one or more ramp surfaces which generally confront the cap and which engage the folded-back regions. The folded-back regions resiliently curl up against the ramp and, therefore, tend to push the ramp surface inwardly of the container. This tends to draw the cap against the exterior of the wall of the container.

According to a preferred construction, the dispenser is rotatable in the opening in the wall of the container to cause the folded-back regions to cooperate with the ramp surface. To facilitate puncturing of the wall of the container, the penetrator preferably has a first region which is of progressively increasing cross-sectional area as the penetrator extends from the puncturing end portion toward the inner end portion. To facilitate rotation of the dispenser, the penetrator preferably has a second region adjacent the inner end portion which is of lesser cross-sectional area than the maximum cross-sectional area of the first region. Accordingly, by placing the second region in the opening punctured by the first region, rotation of the dispenser is facilitated.

By appropriately inclining the ramp or ramp surface, the ramp cooperates with the wall of the container in response to rotation of the dispenser to cam the dispenser downwardly. This draws the cap toward the exterior surface of the container wall. In addition, a portion of the folded region rides up on the ramp surface as the dispenser is rotated. This causes such portion of the folded region to resiliently curl against the ramp and urge the cap against the container wall.

The penetrator preferably is of non-circular cross-sectional configuration so that it produces an opening which is also of non-circular configuration. Rotation of the dispenser relative to the container wall angularly displaces the penetrator relative to the opening. The dispenser includes stop means for stopping the rotation of the dispenser at the desired location.

Construction of the dispenser is facilitated by integrally molding the dispenser of plastic material and in a flat condition. The penetrator and connecting means are then formed by a multiplicity of sections which can be joined by means which includes snap-fit retention means. In its simplest form, each of these sections of the penetrator provides one relatively flat exterior side surface of the penetrator. Self-hinging plastic is used to enable the sections to form the penetrator.

The invention, together with additional features and advantages thereof, may best be understood by reference to the following description taken in connection with the accompanying illustrative drawing.

BRIEF DESCRIPTION OF THE DRAWING

FIG. 1 is a fragmentary side elevational view of a container having a dispenser constructed in accordance with the teachings of this invention mounted on the upper wall thereof.

FIG. 2 is a top plan view of one embodiment of the dispenser with the dispenser laid out flat.

FIG. 3 is a perspective view of the dispenser showing how sections of the dispenser can be folded to form the penetrator.

FIG. 4 is a perspective view of the completed dispenser installed in a container wall with the container wall being shown in dashed lines.

DESCRIPTION OF THE PREFERRED EMBODIMENT

Figure 5:
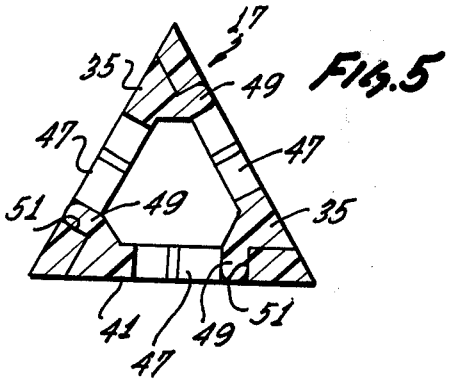
FIG. 5 is an enlarged sectional view taken generally along line 5—5 of FIG. 4.

FIG. 1 shows a dispenser 11 installed on an upper container wall 13 of a container 15. The container 15 may be constructed of paper, cardboard, etc., and may contain, for example, a granular food product, such as salt.

Generally, the dispenser 11 includes a penetrator 17 for puncturing the container wall 13 to form an opening 19, a cap 21 for closing the opening 19, a connector 23 for joining the penetrator to the cap, and a closure 25 which is openable to allow the granular product to be dispensed through the dispenser 11. Although the dispenser 11 can be constructed in different ways, according to a preferred construction, the dispenser is integrally constructed from a single piece of molded plastic material which can be molded in the flat condition shown in FIG. 2. Any plastic material compatible with the granular product with which it is to be used and which provides a self-hinging characteristic can be utilized.

As shown in FIG. 2, the cap 21, in the embodiment illustrated, is generally triangular as viewed in plan and it comprises an end wall 27 and a peripheral flange 29 (FIG. 3). The end wall 27 has a plurality of holes 31 within a cylindrical upstanding boss 33.

Two sections 35 of identical construction are integrally hinged about hinges 37, respectively, to undercut regions 39 on two sides of the flange 29. A third section 41 is similarly hinged to a third side of the flange 29 about a hinge 37. The closure 25 is integrally joined to the cap 21 by a strap 43 so that the closure can be snap fit over the upstanding boss 33 to cover the holes 31.

The sections 35 and 41 have sides 44 which generally taper toward each other as they extend toward the distal end of the associated section, with the section 41 terminating in a point 45. Each of the sections 35 and 41 has an aperture 47 and a snap-fit connection which includes a tab 49 and a recess 51. The section 41 has a ledge 53 for supporting the blunt distal ends 55 of the sections 35.

Each of the sections 35 and 41 includes an identical connector strap 57 which joins such section to the hinge 37. Each of the connector straps 57 includes a narrow neck section 59 and an enlarged stop section 61 which includes a leading edge 63. The stop section 61 is narrower than the widest part of the penetrator. A ramp 65 is integral with the inner end of each of the sections 35 and 41 and projects perpendicularly away from the associated section. Except for the ramp 65, each of the sections 35 and 41 has a generally flat exterior surface.

To assemble the dispenser 11 from the flat condition shown in FIG. 2, each of the sections 35 and 41 with the associated connector straps 57 is pivoted about its respective hinges 37 as shown in FIG. 3 to form the penetrator 17 and the connector 23. As shown in FIG. 5, the tabs 49 are snap fit within the recess 51 of the associated section. Thus, the penetrator 17 as viewed in FIG. 5 is of hollow triangular cross section, with the apertures 47 providing communication to the interior of the penetrator. The end edges of the sections 35 and 41 engage in surface-to-surface contact, and the exterior side surfaces of the triangular configuration shown in FIG. 5 are generally flat and planar. The point 45 defines a puncturing end portion for the penetrator 17, and the penetrator is of progressively increasing cross-sectional area as it extends from the puncturing end toward its inner end portion. The connector 23 at the neck sections 59 defines a neck or region which is of lesser cross-sectional area than the maximum cross-sectional area of the penetrator. The ramps 65 are identical and, with the axis of the dispenser 11 vertical, slope downwardly uniformly and project laterally outwardly.

Figure 6:
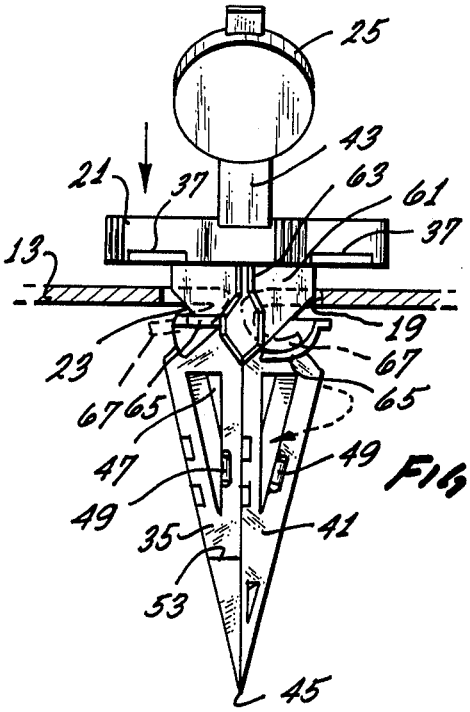
FIG. 6 is a fragmentary sectional view of the dispenser and container wall showing installation of the dispenser.
Figure 7:
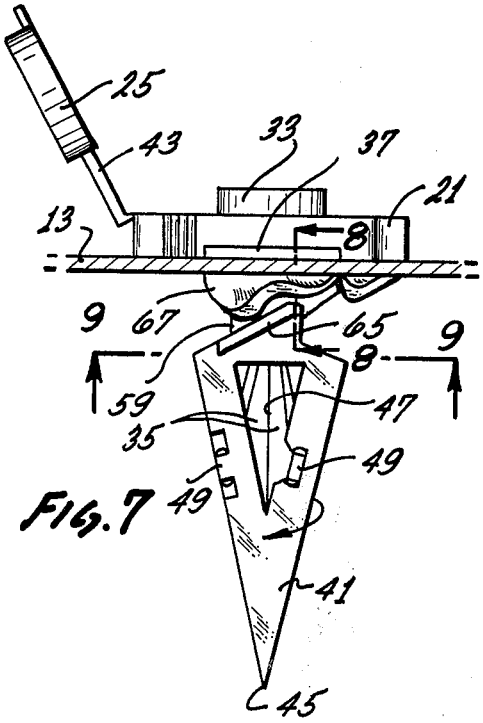
FIG. 7 is a side elevational view of the dispenser installed on a container wall.
Figure 9:
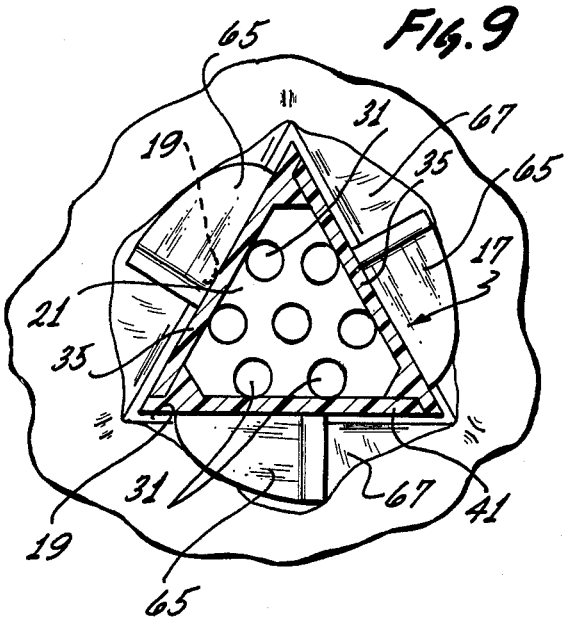
FIG. 9 is a sectional view taken generally along line 9—9 of FIG. 7.
Figure 8:
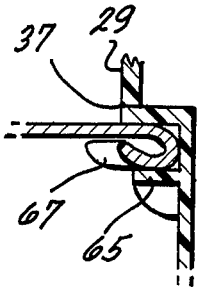
FIG. 8 is a fragmentary sectional view showing how one of the ramps cooperates with a folded-back region of the container wall.

In use, the point 45 can be forced axially through a penetrable container wall, such as the container wall 13, to form the opening 19 with the opening 19 being generally triangular as shown in FIG. 9. The penetration of the container wall 13 produces folded regions 67 which extend into the container along each of the edges of the triangular opening 19. The penetrator 17 is advanced through the opening 19 to place the connector 23, which is of reduced cross-sectional area in the opening. This enables the dispenser 11 to be rotated relative to the container wall 13 in the same direction as the downward slope of the ramps 65. As the dispenser 11 is rotated, the ramps 65 engage beneath the folded regions 67, respectively, and cause the ramps to act as screw threads and draw the cap 21 downwardly into engagement with the container wall 13 as shown in FIG. 7. In addition, the engagement between the ramps 65 and the associated folded regions 67 curls these folded regions as indicated in FIGS. 4, 6 and 8, with the resilience of the folded regions urging the ramps 65 and hence the cap 21 downwardly. This tends to seat the cap 21 tightly against the exterior surface of the container wall 13.

More specifically, with respect to the illustrated embodiment, the opening 19 may be considered to be in the form of an equilateral triangle, although the degree to which the container wall 13 ruptures is a function of the material from which the container wall is made and the manner of insertion of the penetrator 17. In this example, the rotation of the dispenser 11 is through approximately 120 degrees so that the ramp 65 of one of the sections 35 cooperates with the folded-back region 67 which was formed by an adjacent section 35 or 41 during the penetration of the container wall 13. Rotation of the dispenser to this degree is sufficient to realign the triangular cross section of the penetrator 17 with the triangular opening 19 as shown in FIG. 9, with these two elements being displaced 120 degrees from their relative angular locations following the axial insertion of the penetrator. In the location shown in FIGS. 4 and 9, the stop sections 61 engage the straight sides of the triangular opening 19, respectively, to inhibit additional rotation of the dispenser 11. Because the stop section 61 is narrower than the widest part of the penetrator 17, it can be rotated into the triangular opening 19.

Although an exemplary embodiment of the invention has been shown and described, many changes, modifications and substitutions may be made by one having ordinary skill in the art without necessarily departing from the spirit and scope of this invention.

I claim:

1. A dispenser for penetrating a container and dispensing a flowable material from the container, said dispenser comprising:

a penetrator for puncturing a wall of the container and folding back regions of the wall to form an opening in the wall of a size to receive the penetrator, said penetrator having a puncturing end portion configured to facilitate puncturing of the wall of the container and an inner end portion remote from the puncturing end portion;

a cap sized to cover the opening formed by the penetrator;

connecting means for attaching the penetrator to the cap whereby the cap can be on the exterior of the wall of the container when the penetrator is within the container and the connecting means can project through the opening in the wall of the container to join the penetrator to the cap;

said penetrator including a plurality of sections hinged to said cap and means for joining said sections together;

means for engaging the wall of the container to hold the cap against the exterior of the wall of the container; and passage means at least partially in said cap for providing communication between the interior of the container and the exterior of the dispenser when the dispenser is in position on the container.

2. A dispenser as defined in claim 1 wherein said engaging means is adjacent said inner end portion of the penetrator and projects laterally outwardly to engage at least a portion of the folded-back regions, said penetrator has a first region which is of progressively increasing cross-sectional area as the penetrator extends from the puncturing end toward said inner end portion and a second region adjacent said inner end portion which is of lesser cross-sectional area than the maximum cross-sectional area of the first region whereby the dispenser can be more easily rotated, said engaging means being positioned so that the folded-back regions engage the engaging means to hold the cap against the exterior of the wall of the container following such rotation of the dispenser.

3. A dispenser as defined in claim 1 wherein said sections have generally flat exterior surfaces and said joining means includes snap-fit means for retaining said sections together.

4. A dispenser as defined in claim 1 wherein said dispenser is integrally constructed from a single piece of plastic material.

5. A dispenser as defined in claim 3 wherein said engaging means includes a plurality of ramps on said sections, respectively, each of said ramps having a ramp surface generally confronting said cap.

6. A dispenser as defined in claim 1 wherein said passage means extends through said cap and through at least one of said connecting means and said penetrator and including closure means for closing said passage means.

7. A dispenser as defined in claim 2 wherein said penetrator is of non-circular, cross-sectional configuration whereby the opening in the wall is also of non-circular cross-sectional configuration and said dispenser includes stop means for stopping the rotation of the dispenser relative to the container following rotation of the dispenser to a preselected position.

8. A dispenser as defined in claim 7 wherein the stop means includes a region of said connecting means positioned to engage at least one of the sides of the non-circular opening.

9. A dispenser as defined in claim 1 wherein said cap includes an end wall and a peripheral flange and said sections are hinged to said peripheral flange.

10. A dispenser as defined in claim 1 wherein said engaging means includes first and second inclined ramps on first and second of said sections, respectively.

11. A dispenser as defined in claim 1 wherein one of said sections is joined to said cap by a first hinge and includes a connector strap which joins said one section to said first hinge, said one connector strap offsetting a region of said one section radially inwardly from said first hinge.

12. A dispenser as defined in claim 1 wherein at least one of said sections includes a narrow neck adjacent said engaging means.

13. A dispenser as defined in claim 12 wherein said cap includes an end wall and a peripheral flange and said sections are hinged to said peripheral flange, said engaging means includes first and second inclined ramps on first and second of said sections, and one of said sections is joined to said cap by a first hinge and includes a connector strap which joins said one section to said first hinge, said one connector strap offsetting a region of said one section radially inwardly from said first hinge.

14. A dispenser for penetrating a container and dispensing flowable material from the container, said dispenser comprising:

an elongated penetrator having a puncturing end portion and an inner end portion remote from the puncturing end portion;

a cap of larger cross-sectional area than the penetrator;

connecting means for attaching the penetrator adjacent the inner end portion thereof to the cap;

means defining at least one ramp surface adjacent said inner end portion of the penetrator, said ramp surface projecting generally laterally outwardly of the penetrator;

passage means extending through the cap and through at least one of said connecting means and said penetrator to thereby provide a passage through the dispenser;

said penetrator having a first region which is of progressively increasing cross-sectional area as the penetrator extends from the puncturing end portion toward the inner end portion and a second region adjacent the inner end portion which is of lesser cross-sectional area than the maximum cross-sectional area of the first region; and said dispenser being integrally constructed from a single piece of plastic material, said penetrator and said connecting means comprising a plurality of sections and means including snap-fit retention means for holding said sections together.

* * * * *